US007477022B2

(12) United States Patent
Wi et al.

(10) Patent No.: US 7,477,022 B2
(45) Date of Patent: Jan. 13, 2009

(54) SYSTEM AND METHOD FOR DRIVING A MULTI-LAMP

(75) Inventors: Soon-Im Wi, Suwon-si (KR); Sang-Don Choi, Gunpo-si (KR)

(73) Assignee: New Power Plasma Co., Ltd. (KR)

( * ) Notice: Subject to any disclaimer, the term of this patent is extended or adjusted under 35 U.S.C. 154(b) by 532 days.

(21) Appl. No.: 11/339,845

(22) Filed: Jan. 26, 2006

(65) Prior Publication Data

US 2008/0061708 A1 Mar. 13, 2008

(30) Foreign Application Priority Data

Jan. 26, 2005 (KR) ..... 10-2005-0007157

(51) Int. Cl.
*H05B 41/16* (2006.01)

(52) U.S. Cl. ..... 315/282; 315/291; 315/246; 315/276; 315/277; 315/312

(58) Field of Classification Search ..... 315/209 R, 315/212, 220, 246, 254, 255, 276, 277, 282, 315/291, 312
See application file for complete search history.

(56) References Cited

U.S. PATENT DOCUMENTS 5,717,422 A 2/1998 Fergason
6,104,146 A * 8/2000 Chou et al. ..... 315/277
6,717,372 B2 4/2004 Lin et al.
7,291,987 B2 * 11/2007 Chang et al. ..... 315/282
7,408,306 B2 * 8/2008 Tanaka et al. ..... 315/277

* cited by examiner

*Primary Examiner*—Haissa Philogene
(74) *Attorney, Agent, or Firm*—McNeely Bodendorf LLP

(57) ABSTRACT

A system for driving a multi-lamp, and more particularly to, a system for driving a multi-lamp for driving a parallel arrangement of a plurality of discharge lamps and a method of driving a plurality of discharge lamps and a method thereof. The multi-discharge lamp driving system comprises: a power transformer for producing a positive voltage and a negative voltage upon receipt of an alternative power source from an alternative power supply source; and a current balance distributor for being supplied with the positive voltage produced from said power transformer to divide the supplied positive voltage into a plurality of predetermined voltages, and for applying the divided predetermined voltages to the corresponding electrodes of a plurality of discharge lamps consisting of a lamp array for the purpose of distributing an amount of a current flow so that the distributed current flow inputted into each of the plurality of discharge lamps may keep to make a mutual balance from each other, wherein the negative voltage is commonly applied to second electrodes of the plurality of discharge lamps.

21 Claims, 14 Drawing Sheets

SYSTEM AND METHOD FOR DRIVING A MULTI-LAMP

CLAIMS OF PRIORITY

This application makes reference to, incorporates the same herein, and claims all benefits accruing under 35 U.S.C. §119 from an application entitled SYSTEM AND METHOD FOR DRIVING A MULTI-LAMP earlier filed in the Korean Intellectual Property Office on 26 Jan. 2005 and there duly assigned Ser. No. 10-2005-0007157.

BACKGROUND OF THE INVENTION

1. Field of the Invention

The invention relates to a system for driving a multi-lamp (multiple lamps), and in particular to a system for driving a multi-lamp which can be used for a backlight (back light) in a passive display device such as a liquid crystal display device, and a method thereof.

2. Description of the Prior Art

In a general passive display device such as a liquid crystal display device used for a television or a computer monitor, a backlight unit as a non-emissive type device is needed to emit a light from its rear side. The backlight unit can be compartmentalized into a fall perpendicular emission method and an edged emission method depending on a light source. The increasing of a display size is made on the main use of the fall perpendicular emission method. A side light source in the fall perpendicular emission method is made up with a parallel arrangement of a plurality of discharge lamps. Currently, a cold cathode fluorescent lamp or an external electrode fluorescent lamp is being used as a discharge lamp.

To drive a parallel arrangement of a plurality of discharge lamps, it has been known to have many problems which can be overcame. For examples, the size increase of the discharge lamps in connection with increasing a display size results in a rise phenomenon of a driving voltage, problems with insulation durability, and so on, of the discharge lamp. It has already been known that this rise phenomenon does not make the discharge lamps to be stably driven. Therefore, an independent driving inverter module in each of the discharge lamps should be utilized in a back light unit adopted for the fall perpendicular emission method. This results in a serious affect on a price rise of the backlight unit and also an increase of unnecessary weight and size of the backlight unit.

It is, moreover, very difficult to have a uniformity of a illumination intensity over an entire luminous square in the back light unit because in each of the plurality of discharge lamps its operation is driven by a corresponding independent driving inverter module. To solve the above described problems a current balance technique capable of obtaining a uniformity of illumination intensity and of driving a parallel arrangement of the discharge lamps in a backlight unit has been suggested.

A system for driving a parallel arrangement of a plurality of discharge lamps is described in U.S. Pat. No. 6,717,372 to Wei-Hong Lin et al. and titled "Multi-Lamp Driving System". The above disclosed system can basically drive two discharge lamps using one transformer of which a secondary winding is coupled to the parallel arrangement of two discharge lamps. Two windings having a common winding at one magnetic core is coupled to between the secondary winding of the transformer and one of two discharge lamps to control a current balance.

In a system for driving a multi-lamp, however, two or more transformers should be used to drive two or more discharge lamps. Further, characteristics of each discharge lamp and each of circuit elements are ideally not the same. Due to this fact, it is substantially difficult to make many lamps to be entirely and uniformly kept on a current balance.

It is, however, difficult to obtain a uniform current balance in this parallel arrangement. The changeable rage of most of voltages generated from a current deviation between discharge lamps exists within a partial voltage compared with the whole discharge voltage of the discharge lamp. Therefore, it is ineffective to have a current balance in the whole range of discharge voltage.

In a general passive display apparatus, the brightness of a backlight and a light intensity of the peripheral circumferences can exert an influence on the contrast of an optical image to be displayed on the passive display apparatus. Further, the contrast of an optical image to be displayed on the passive display apparatus can an act on scene characteristics of the displayed optical image, that is, the decreasing of a number of the displayed picture elements can result in a display of lower definition degree.

To solve the above problems of the passive display apparatus, new technologies have been suggested in which the brightness of the backlight can be adjusted depending on the light intensity of the peripheral circumferences and the characteristics of the displayed optical image. One of new technologies is the disclosure being directed to a high contrasted passive display device discusses in U.S. Pat. No. 5,717,422 to James L. Fergason titled "Variable Intensity High Contrast Passive Display". The brightness intensity of a light source in Fergason's passive display device can be adjusted depending on the light intensity of the peripheral circumference and the characteristics of the displayed optical image. A brightness adjustment of a light source used in Fergason's passive display device may apply to an entire light source. Because of this, it is very difficult to realize a higher contrast in case of a partial dark scene or a partial bright scene.

In view of an electric power consumption, it looks forward to be partially low in electric power consumption during display of a dark scene by the control of a light source. During display of a partial bright scene by the control of a light source, the electric power consumption is kept to be higher due to the application of the whole rise of the brightness to a light source.

When an optical image to be displayed on the passive display device can become dark or bright under the darkness of a light source or under a mutual brightness difference of a light source by the control of a light source, the light source can be partially controlled depending on the characteristics of the displayed optical image so as to obtain a high contrast and to save an electric power consumption in effect.

SUMMARY OF THE INVENTION

Accordingly, it is an object of this invention to provide a multi-lamp driving system capable of driving a parallel arrangement of plurality of discharge lamps and of making an illumination uniformity of the plurality of discharge lamps higher.

It is an another object of this invention to provide a system for driving a multi-lamp capable of making an illumination adjustment of discharge lamps different from each other depending on an optical image to be displayed on the passive display apparatus.

According to a first aspect of the present invention, there is provided a system for driving a multi-lamp including a power transformer for producing a positive voltage and a negative voltage upon receipt of an alternative power supply from an alternative power supply source; and, a current balance distributor being supplied with the positive voltage produced from said power transformer to divide the supplied positive voltage into a plurality of predetermined voltages, and for respectively applying the divided predetermined voltages to the corresponding electrodes of a plurality of discharge lamps in a lamp array for the purpose of distributing an amount of a current flow so that the distributed current flow inputted into each of the discharge lamps may keep to make a mutual balance from each other, wherein the negative voltage is commonly applied to second electrodes of the discharge lamps.

According to a second aspect of the present invention, there is provided a system for driving a multi-lamp including: a power transformer for producing a positive voltage and a negative voltage upon receipt of an alternative power supply from an alternative power supply source; a current balance distributor for being supplied with the positive voltage produced from said power transformer to divide the supplied positive voltage into a plurality of predetermined voltages, and for applying the divided predetermined voltages to the corresponding first electrodes of a plurality of discharge lamps in a lamp array for the purpose of distributing an amount of a current flow so that the distributed current flow inputted into each of discharge lamps may keep to make a mutual balance from each other; a first adjustment circuit for variably-adjusting the whole and/or partial level of the divided predetermined voltages applied to the corresponding first electrodes from the current balance distributor; and a control unit for controlling the first adjustment circuit, wherein the negative voltage of the power transformer is commonly applied to a second electrode of the discharge lamps, and wherein the first adjustment circuit under the control of the control unit can adjust the illumination intensity of the plurality of discharge lamps as a whole combination and/or a partial combination.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
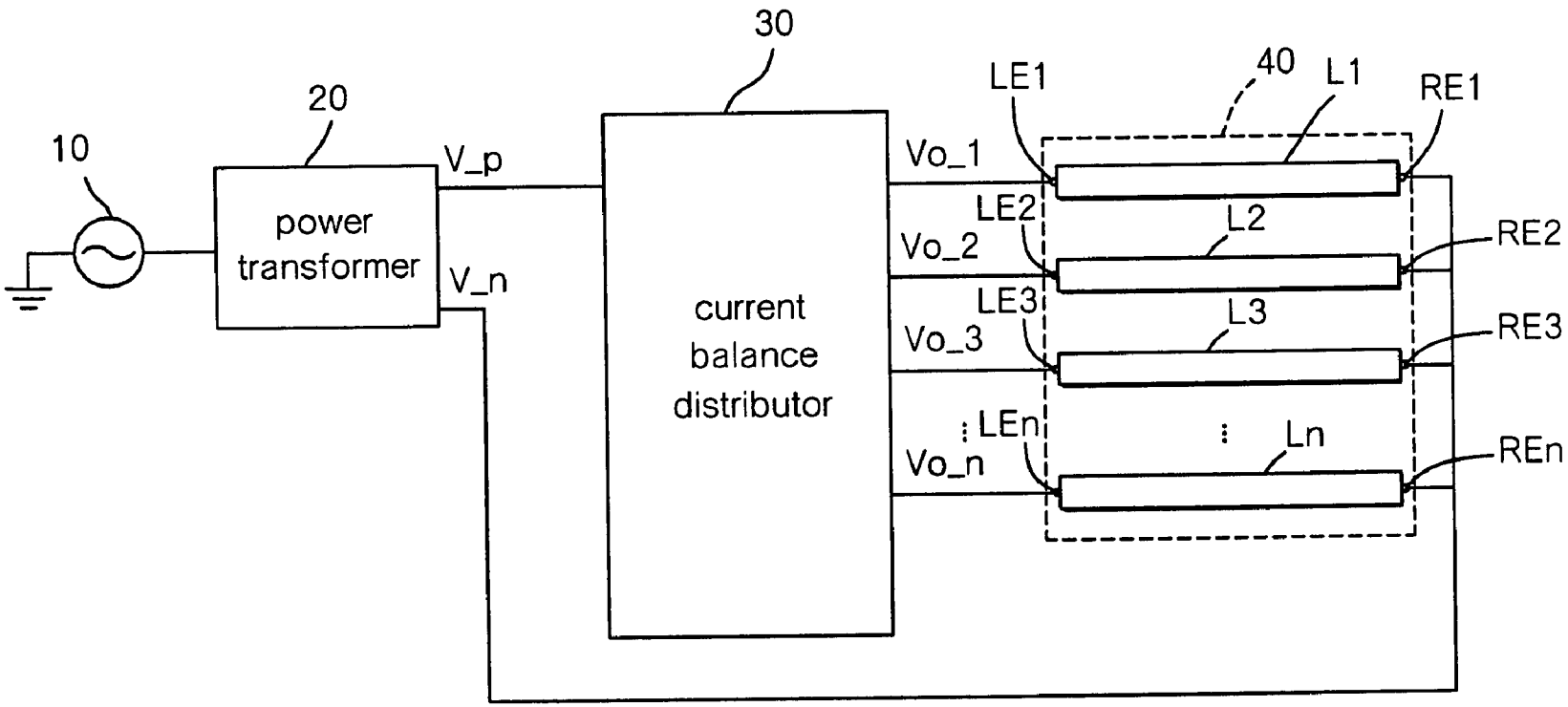
FIG. 1 is a block diagram showing a configuration of a system for driving multi-lamp according to first embodiment of this invention.

To fully understand many objects to be accomplished by various embodiments and operational advantages of this invention, preferred embodiments of this invention will be described in a more detailed manner with reference to the attached drawings. In the attached drawings, like elements will be referred to as like numerals. Furthermore, the detailed technical explanation of already known functions and constructions will be omitted herein to avoid a faint determination of the subject matter of this invention FIG. 1 is a block diagram showing the configuration of a system for driving a multi-lamp according to a first embodiment of the invention. In FIG. 1, a system for driving a multi-lamp according to the first embodiment of the invention includes a power transformer 20, and a current balance distributor 30. Further, this multi-lamp driving system takes the supply of an alternative power supply from an alternative power supply source 10 to drive a parallel arrangement of discharge lamps L1, L2, L3 . . . Ln in a lamp array 40. The lamp array 40 functions as a light source used for a fall perpendicular emission method in a backlight unit of a passive display apparatus such as a liquid crystal display device.

Figure 2:
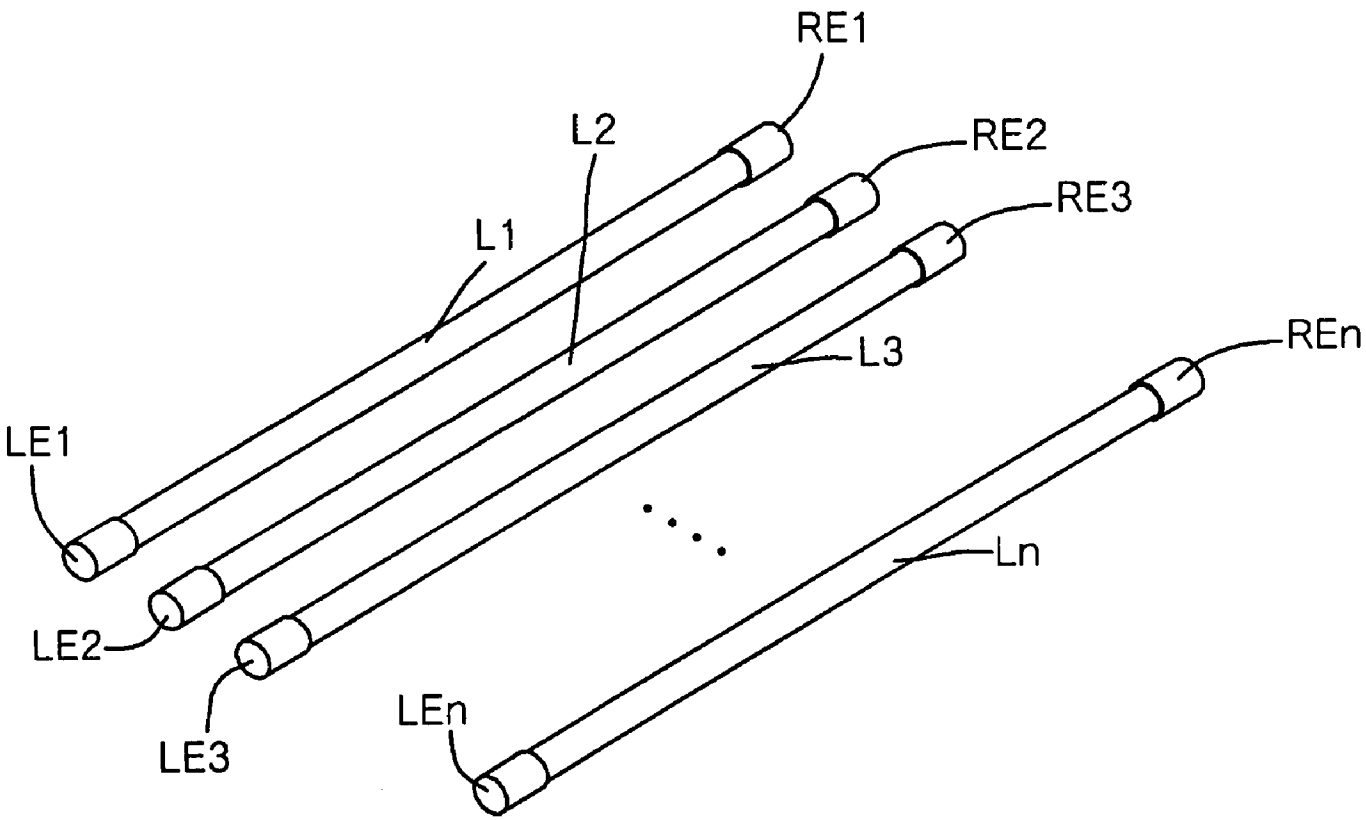
FIGS. 2 and 3 are schematic perspective views showing a structure of one part of the configuration of FIG. 1.
Figure 3:
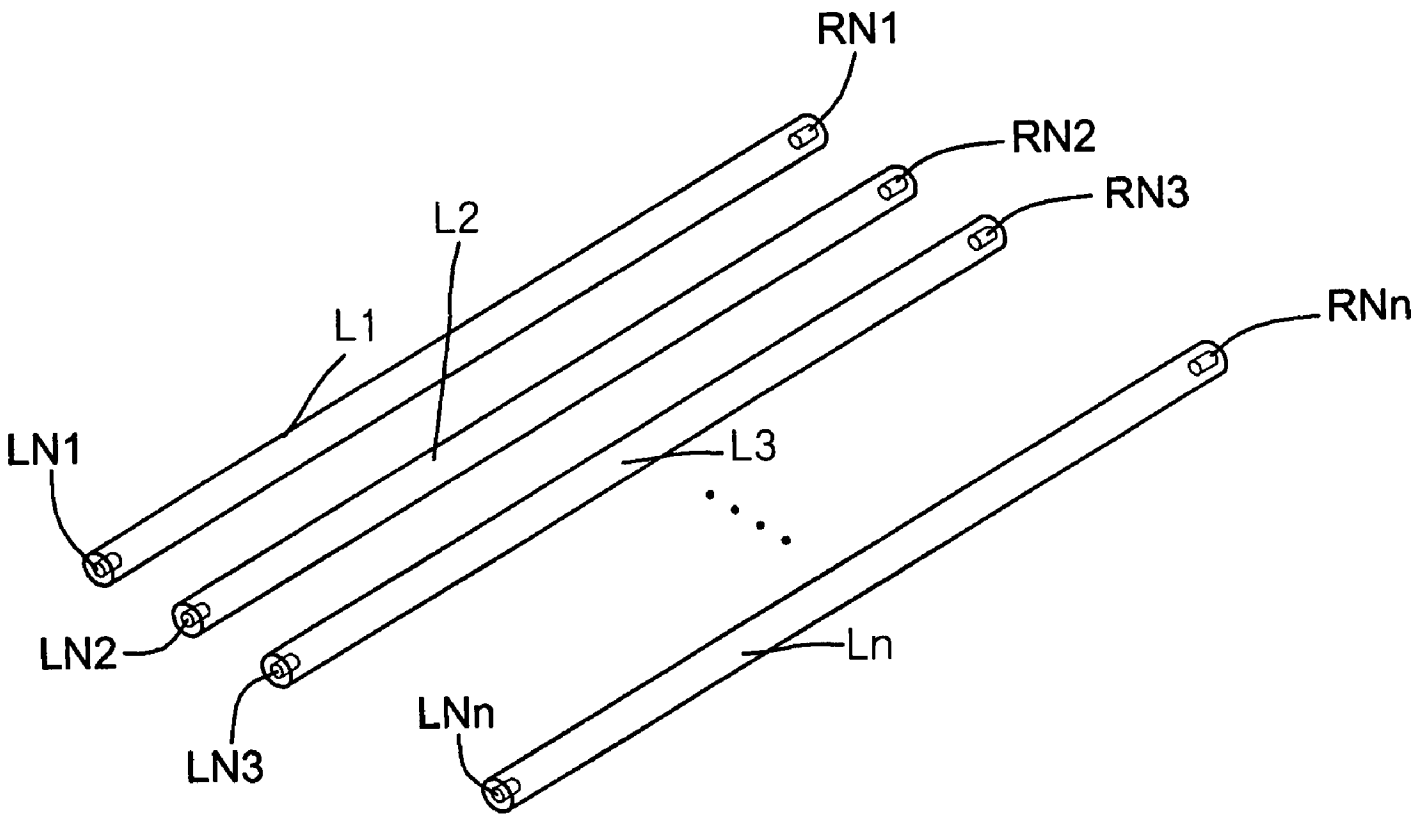

FIGS. 2 and 3 are schematic perspective view showing an external electrode typed discharge lamp or an internal electrode typed discharge lamp in lamp array 40 of FIG. 1. As shown in FIG. 2, lamp array 40 includes a plurality of discharge lamps L1, L2, L3 . . . Ln each having a of a pair of external electrodes RE1 and LE1, RE2 and LE2, RE3 and LE3 . . . REn and LEn. Further, lamp array 40 includes a plurality of discharge lamps L1, L2, L3 . . . Ln each having a of a pair of internal electrodes RN1 and LN1, RN2 and LN2, RN3 and LN3 . . . RNn and LNn, as shown in FIG. 3. Although not shown in the drawings, lamp array 40 includes various modifications of a configuration, for example, one modification is the mixture configuration of external and internal electrodes or any combination configuration of external or internal electrodes. It is possible to use lamp array 40 of the above said modifications as a discharge lamp according to a system for driving multi-lamp of this invention.

Power transformer 20 is provided with an alternative power supply from an alternative power supply source 10 to produce a positive voltage V_p and a negative voltage V_n. Current balance distributor 30 is supplied with the positive voltage V_p to divide the positive voltage V_p into a plurality of predetermined voltages Vo_1 Vo_2, Vo_3 . . . Vo_n which are respectively applied to the corresponding first electrodes LE1, LE2, LE3 . . . LEn of discharge lamps L1, L2, L3 . . . Ln.

The negative voltage V_n is applied, as a common voltage, to second electrodes RE1, RE2, RE3, . . . , REn of discharge lamps L1, L2, L3 . . . Ln. Therefore, discharge lamps L1, L2, L3 . . . Ln can produce, in parallel, a radiation of light.

At this times, current balance distributor 30 divides and adjusts an amount of a current flow such that a value of a respective current inputted into discharge lamps L1, L2, L3 . . . Ln should have a mutual balance. In result, all discharge lamps L1, L2, L3 . . . Ln can respectively emit a light having a uniform illumination.

Figure 4:
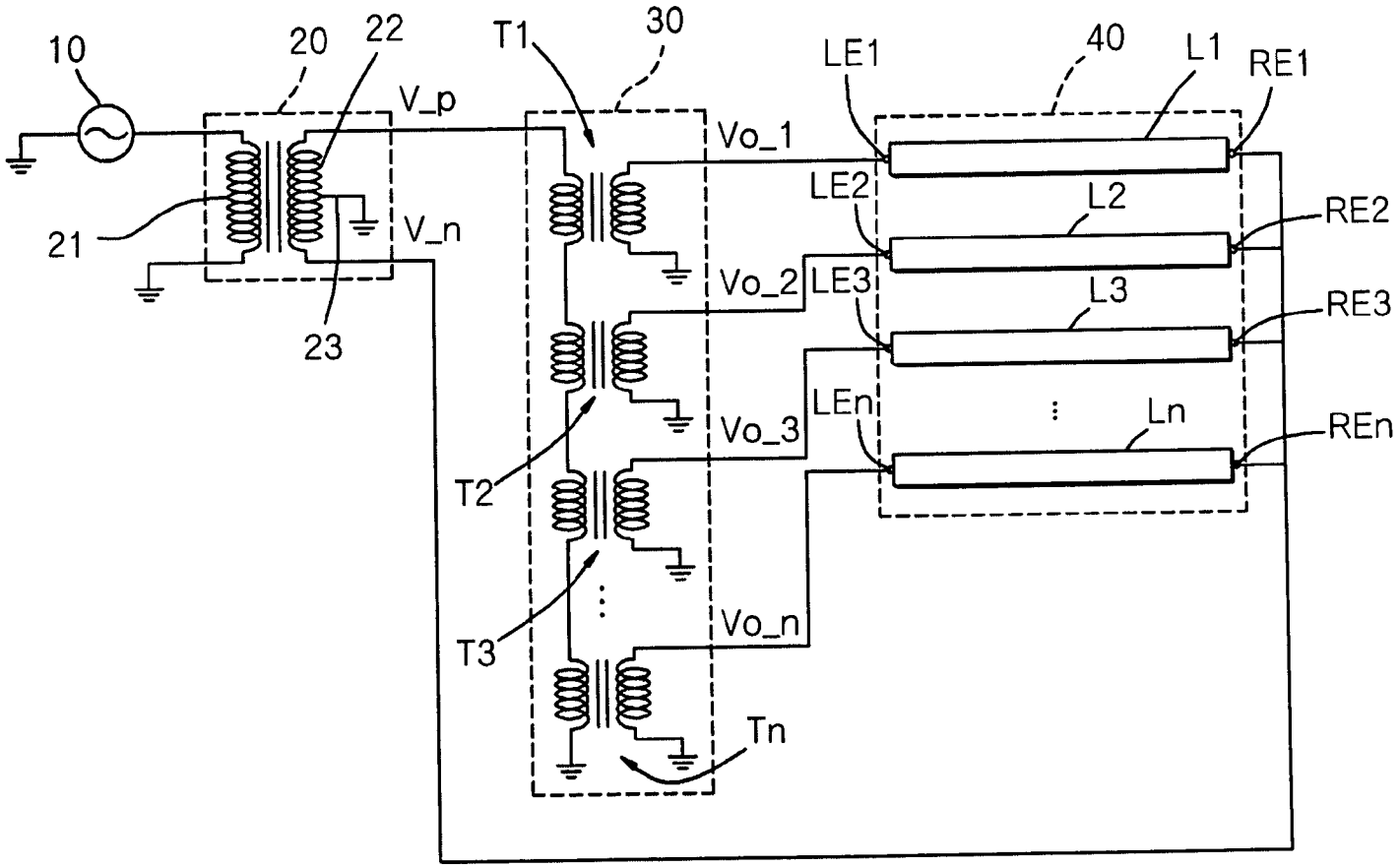
FIG. 4 is a detailed circuit diagram showing structures of different other parts of the configuration of FIG. 1.

Detailed circuits of power transformer 20 and current distributor 30 are shown in FIG. 4. In FIG. 4, one end of a primary winding 21 in power transformer 20 is coupled to alternative power supply source 10 and other end thereof is coupled to a ground. A secondary winding 22 of power transformer 20 has an intermediate tap 23 being coupled to the ground. While the positive voltage V_p is produced from one end of the secondary winding 22, the negative voltage V_n is produced from other end of the secondary winding 22. Hence, the values of the positive voltage V_p and the negative voltage V_n is decided depending on the position of intermediate tap 23. For example, the position of intermediate tap 23 can be set up so that the ratio of the positive voltage V_p and the negative voltage V_n may be 1:2. In this case, a current balance distributor 30 makes a current balance in a range of ⅓ electric power capacity in view of the whole power capacity for a system for driving lamp array 40.

The current balance distributor 30 includes a plurality of transformers T1, T2, T3 . . . Tn respectively corresponding to the plurality of discharge lamps L1, L2, L3 . . . Ln. A ratio of a primary winding and secondary winding at each of transformers T1, T2, T3 . . . Tn is basically set to 1:1. It is, however, possible to change this set ratio. The primary winding at each of transformers T1, T2, T3 . . . Tn is serially coupled between one end of secondary winding 22 of power transformer 20 and a ground. Each of the secondary windings of the plurality of transformers T1, T2, T3 . . . Tn are respectively coupled between first electrodes LE1, LE2, LE3 . . . LEn of the corresponding discharge lamp out of discharge lamps L1, L2, L3 . . . Ln and the ground.

The current balance distributor 30 divides a positive voltage V_p produced from power transformer 20 into a plurality of uniform voltages by transformers T1, T2, T3 . . . Tn. The divided uniform voltages Vo_1, Vo_2, Vo_3 . . . Vo_n are respectively applied to first electrodes LE1, LE2, LE3 . . . LEn of the corresponding discharge lamps L1, L2, L3 . . . Ln. If an impedance of any one of discharge lamps L1, L2, L3 . . . Ln becomes changed so that an amount of a current flow via it may cause to be changed, current balance is maintained because the primary windings of transformers T1, T2, T3 . . . Tn are serially coupled to each other. Therefore, this change makes transformers T1, T2, T3 . . . Tn apply wholly a mutual affect on each other to maintain a current balance. Further, transformers T1, T2, T3 . . . Tn continuously carry out an automatic control to each other so that discharge lamps L1, L2, L3 . . . Ln may mutually have a same illumination intensity.

Figure 5:
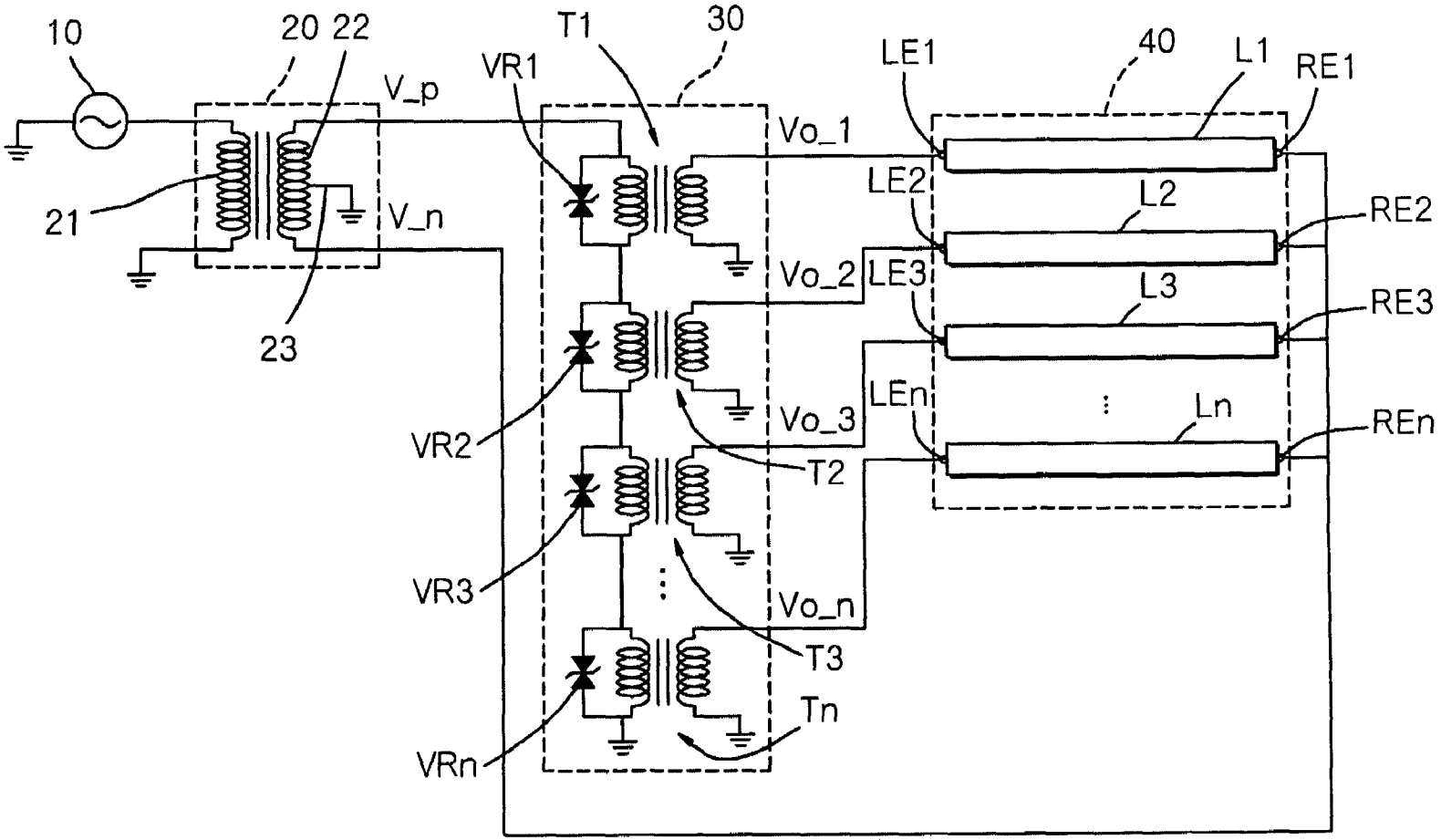
FIG. 5 is a detailed circuit diagram showing a configuration of the addition of a protection circuit to the structure of a current balance distributor.

FIG. 5 is a circuit diagram showing a configuration of additional protection circuits respectively connected to transformers T1, T2, T3 . . . Tn in the current balance distributor 30.

Referring to FIG. 5, transformers T1, T2, T3 . . . Tn in current balance distributor 30 further include respective corresponding protection circuits VR1, VR2, VR3 . . . VRn which are coupled across their primary windings. The respective corresponding protection circuits VR1, VR2, VR3 . . . VRn in current balance distributor 30 block the rising of over-voltage from their respective corresponding transformers T1, T2, T3 . . . Tn. If an electric state of a respective discharge lamp is open, the rising of over-voltage from the corresponding transformer T1, T2, T3 . . . or Tn needs to be blocked. Such protection circuits VR1, VR2, VR3 . . . VRn in current balance distributor 30 are preferably a varistor or a constant voltage diode such as Zener diode.

Figure 6:
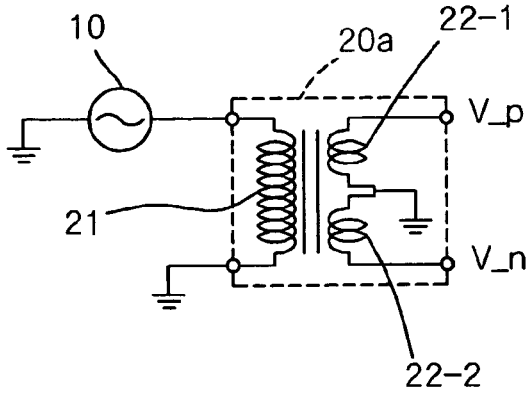
FIGS. 6 to 8 are detailed circuit diagrams showing various modifications of a power transformer according to first embodiment of the present invention.
Figure 7:
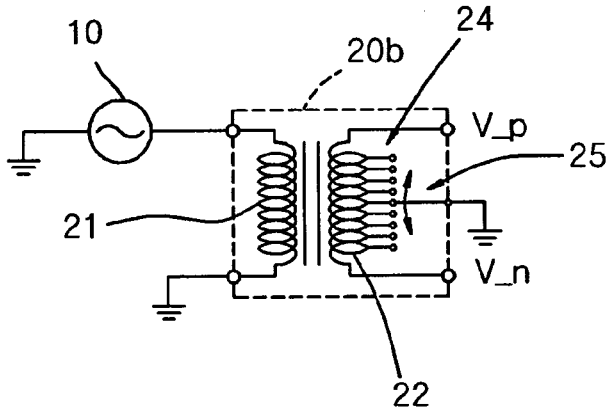
Figure 8:
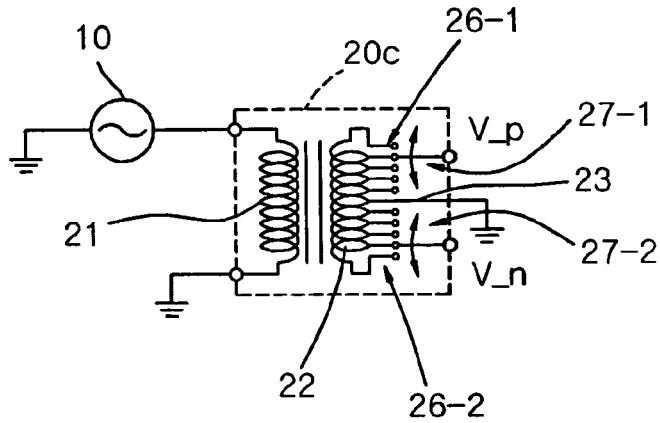

FIGS. 6 to 8 are detailed circuit diagrams separately showing various modifications of power transformer 20.

Referring to FIG. 6, a secondary winding of first power transformer 20*a* according to first modification of power transformer 20 has two windings 22-1 and 22-2 to be divided. One winding 22-1 of these winding 22-1 and 22-2 produces a positive voltage V_p from its one end and its other end is coupled to a ground. Similarly, another winding 22-2 is coupled to the ground at its one end and produces a negative voltage V_n from its other end.

Referring to FIG. 7, second power transformer 20*b* according to a second modification of power transformer 20 has a multi-tap 24 over its secondary winding 22. Further, second power transformer 20*b* includes a multi-tap switching circuit 25 for connecting any one of taps in multi-tap 24 to the ground. A ratio of the positive voltage V_p and the negative voltage V_n is varied according to the switching point of multi-tap switching circuit 25 because any one of taps in multi-tap 24 is connected to the ground.

Referring to FIG. 8, third power transformer 20*c* according to a third modification of power transformer 20 has attached to its secondary winding 22 an intermediate tap 23 coupled to a ground. Also, third power transformer 20*c* further includes at its secondary winding 22 a multi-tap 26-1 connected between one end of secondary winding 22 and intermediate tap 23, and a first multi-tap switching circuit 27-1 produces a positive voltage V_p by being coupled to any one of the taps of first multi-tap 26-1. And, third power transformer 20*c* includes a second multi-tap 26-2 connected between the other end of secondary winding 22 and intermediate tap 23, and a second multi-tap switching circuit 27-2 for producing a negative voltage V_n by being coupled to any one of the taps of second multi-tap 26-2. A ratio of the positive voltage V_p and the negative voltage V_n and a level of the respective voltages V_p and V_n are varied according to the switching point of first and second multi-tap switching circuits 27-1 and 27-2.

Figure 9:
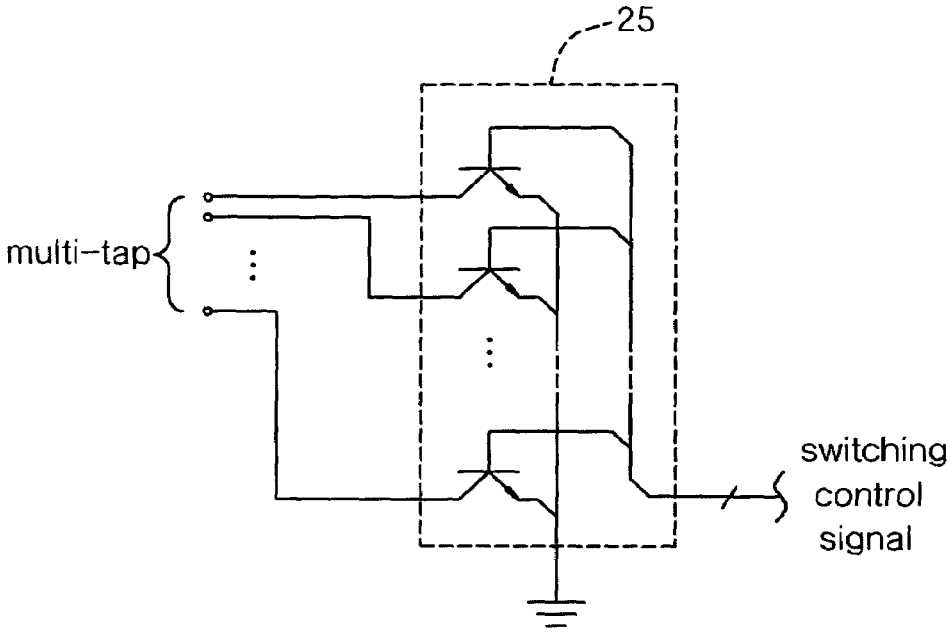
FIG. 9 is a detailed circuit diagram showing one exemplary of the construction of a multi-tap circuit of FIG. 7 according to first embodiment of the present invention.
Figure 10:
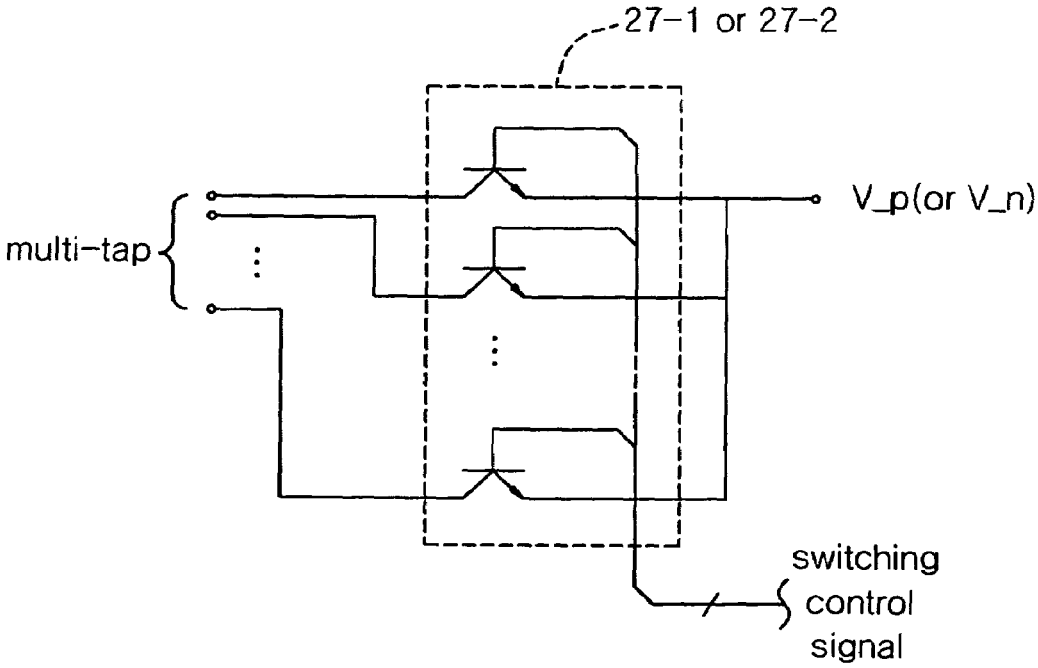
FIG. 10 is a detailed circuit diagram showing another exemplary of the construction of a multi-tap circuit of FIG. 8 according to first embodiment of the present invention.

Multi-tap switching circuit 25 of FIG. 7 and first and second multi-tap switching circuits 27-1 and 27-2 of FIG. 8 preferably are semiconductor switching devices such as a field effect transistor and so on. By applying a control signal to a gate of semiconductor switching device, carrying out its switching operation can be controlled. Also, multi-tap switching circuit 25 of FIG. 7 and first and second multi-tap switching circuits 27-1 and 27-2 of FIG. 8 preferably are a mechanical multi-tap switches. FIG. 9 is a detailed circuit diagram showing one exemplary of the construction of multi-tap circuit 25 comprised of a semiconductor switching device according to one embodiment of the present invention; and FIG. 10 is a detailed circuit diagram showing another exemplary of the construction of multi-tap circuits 27-1 or 27-2 comprised of a semiconductor switching device according to first embodiment of the present invention;

In a way, a discharge lamp includes an internal electrode such as CCFL (Cold Cathode Flourescent Lamp) and an external electrode such as EEFL (External Electrode Flourescent Lamp). In the case of the internal electrode, accelerated ion particles in the discharge lamp collide directly with the internal electrode. Due to this collision, a life cycle of the internal electrode becomes short. In the case of the external electrode, the collision of accelerated ion particle with both ends of discharge tube in the discharge lamp can produce a pin hole.

To overcome the above problems, a system for driving a multi-lamp according to the invention includes an arrangement of a magnetic core coil-winded at the peripheral of both electrodes of a respective discharge lamp in order to inhibit the acceleration of ion particles from both ends of the respective discharge lamp.

Figure 11:
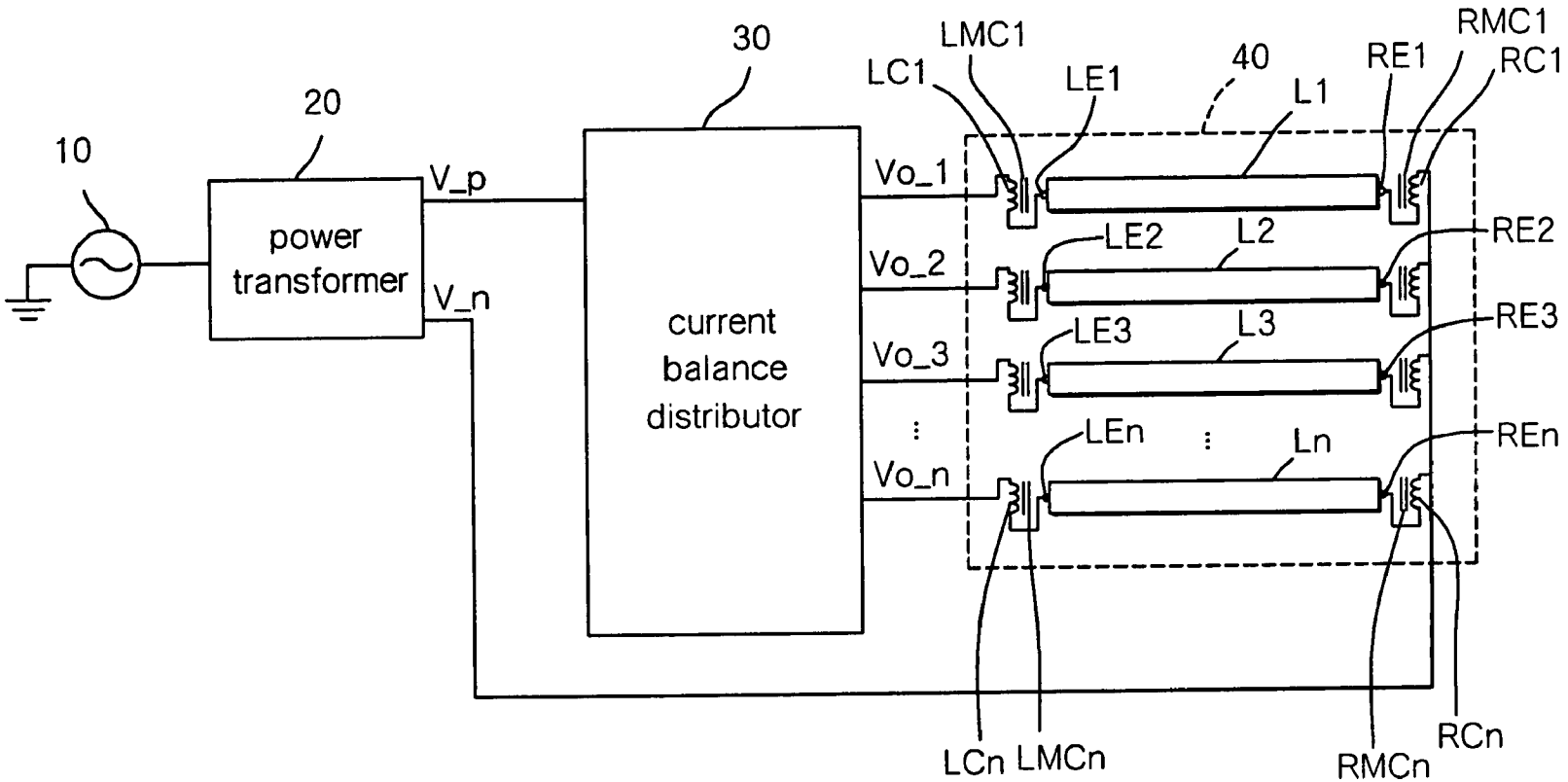
FIG. 11 is a block diagram showing a configuration of the addition of the structure of a magnetic core to a lamp array of FIG. 1.

FIG. 11 shows one embodiment of a system for driving a multi-lamp with the addition of a magnetic core. In FIG. 11, the peripheral of a respective pair of first and second electrodes LE1 and RE1, LE2 and RE2, LE3 and RE3, . . . , LEn and REn respectively connected at both ends of each of discharge lamps L1, L2, L3 . . . Ln is equipped with the corresponding respective pair of first and second magnetic cores LMC1 and RMC1 . . . LMCn and RMCn, wherein one end of first magnetic cores LMC1 . . . LMCn are respectively connected to the corresponding first electrodes LE1 . . . LEn in discharge lamps L1 . . . Ln, and the other end of first magnetic cores LMC1 . . . LMCn are respectively connected to first windings LC1 . . . LCn coupled to the corresponding output terminals of current balance distributor 30 at which divided voltages Vo_1, Vo_2, Vo_3 . . . Vo_n are output.

Similarly, one end of second magnetic cores RMC1 . . . RMCn are respectively connected to the corresponding second electrodes RE1 . . . REn in discharge lamps L1 . . . Ln, and their other ends are respectively equipped with second windings RC1 . . . RCn commonly connected to one output terminal of power transformer 30 at which a negative voltage V_n is output. The respective pair of first and second magnetic cores LMC1 and RMC1 . . . LMCn and RMCn are coupled across discharge lamps L1 . . . Ln and to the peripheral of a respective pair of first and second electrodes LE1 and RE1 . . . LEn and REn so as to block the acceleration of ion particles to generate a magnetic field.

Second embodiment of a system for driving a multi-lamp will be explained in reference with FIGS. 12 to 15.

Figure 12:
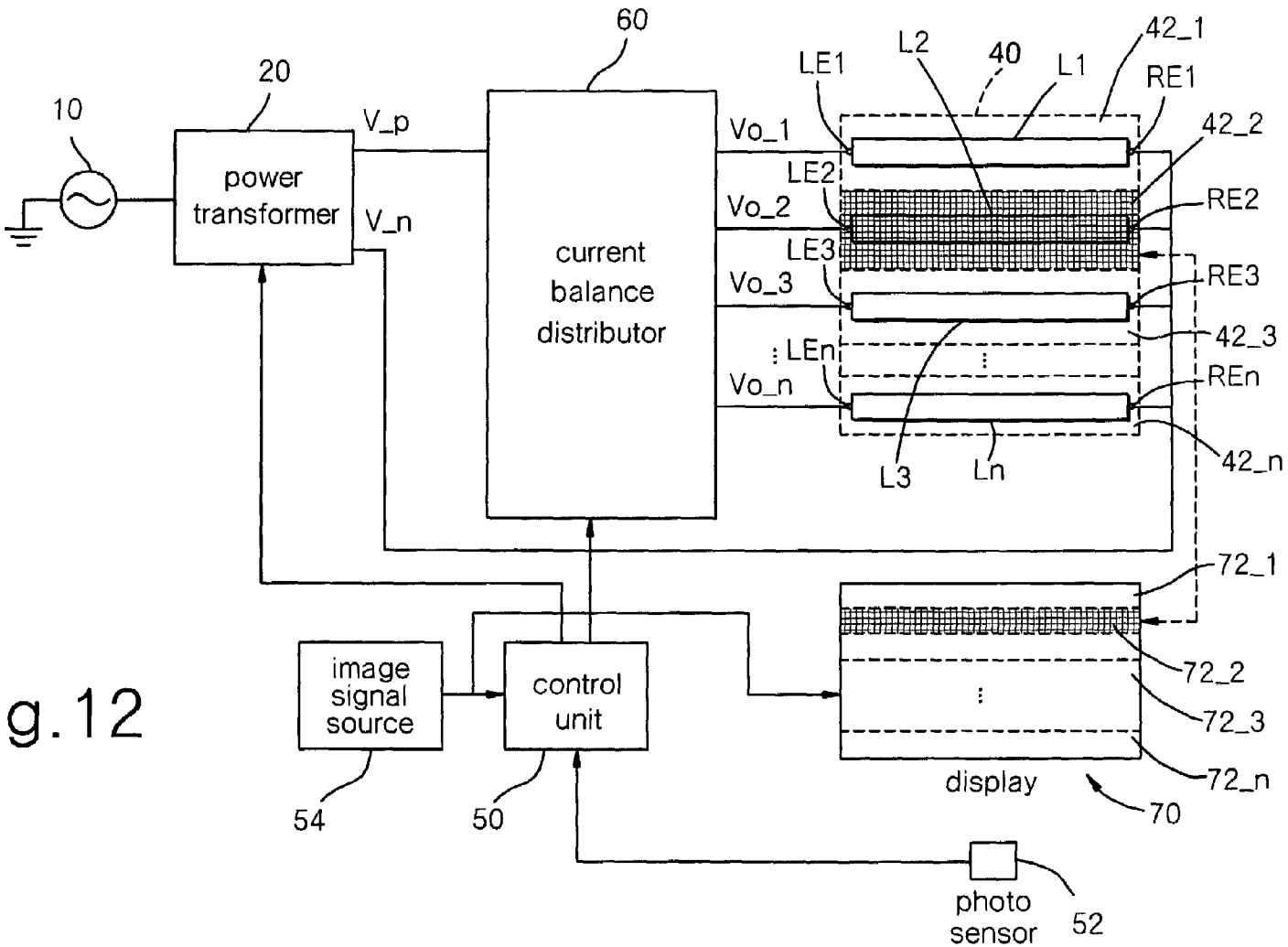
FIG. 12 is a block diagram showing a configuration of a system for driving multi-lamp according to second embodiment of this invention.

FIG. 12 is a block diagram showing the configuration of a system for driving a multi-lamp according to second embodiment of this invention. In FIG. 12, the configuration of second embodiment of a system for driving a multi-lamp is the same as that of first embodiment of a driving system for a multi-lamp. The configuration of second embodiment of a system for driving a multi-lamp further includes control unit 50, besides that of first embodiment of a system for driving a multi-lamp. In addition, an optical sensor may be included therein. Hence, the same elements as those of first embodiment of a system for driving a multi-lamp will be not explained in FIG. 12.

A lamp array 40 having a parallel arrangement of discharge lamps is provided with a light source in a backlight unit of a fall perpendicular emission method such as a liquid crystal display device. In FIG. 12, an image signal from an image signal source 54 is provided to a television system as a picture signal or a video controller of a computer system as a video signal.

On basis of illumination information included in an image signal provided from an image signal source 54, control unit 50 can control current balance distributor 60 to variably control the level of the whole combination or the partial combination of divided voltages Vo_1, Vo_2, Vo_3 . . . Vo_n so as to wholly or partially adjust the illumination intensity of discharge lamps L1, L2, L3 . . . Ln in lamp array 40. Additionally, the variable control by control unit 50 can carry out the application of incorporation in the degree of an illumination intensity under an external circumstance sensed from a photo sensor 52 in connection with the to whole or partial control of the illumination intensity of the plurality of discharge lamps L1, L2, L3 . . . Ln.

For example, control unit 50 makes a distinction about the corresponding respective scene displaying region 42_1, 42_2, 43_3 . . . 42_n of a passive display apparatus 70 corresponding to a respective turned-on region 72_1, 72_2, 72_3 . . . 72_n, and can wholly or partially adjust the illumination intensity of discharge lamps L1, L2, L3 . . . Ln in lamp array 40, base on illumination information included in an image signal to be displayed on the respective turned-on region 72_1, 72_2, 72_3 . . . 72_n.

For the adjustment of the illumination intensity, a system for driving a multi-lamp is equipped with a first adjusting member for variably-adjusting the level of the whole combination or partial combination of divided voltages Vo_1, Vo_2, Vo_3 . . . Vo_n produced from a current balance distributor 60.

Figure 13:
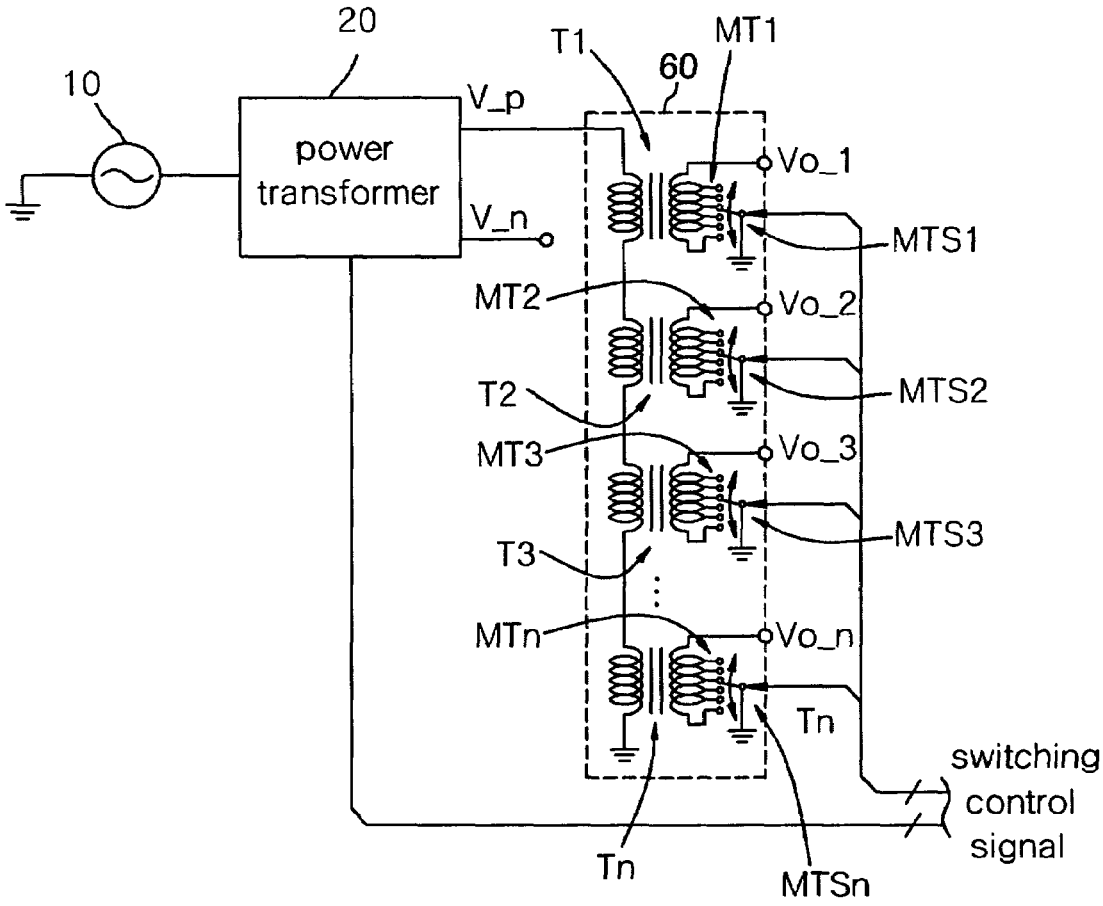
FIG. 13 is a detailed circuit diagram showing a structure of one part of the configuration of FIG. 12.

FIG. 13 shows a circuit diagram of a current balance distributor 60 of FIG. 12. In FIG. 13, current balance distributor 60 is provided with a plurality of transformers T1, T2, T3 . . . Tn respectively corresponding to a plurality of discharge lamps L1, L2, L3 . . . Ln, like the above first embodiment. The respective primary windings of transformers T1, T2, T3 . . . Tn are serially coupled between a ground and an output terminal of transformer 20 at which a positive voltage V_p output. The respective secondary windings of transformers T1, T2, T3 . . . Tn are each coupled between a ground and a respective first electrode LE1, LE2, LE3 . . . LEn of (FIG. 12) discharge lamps L1, L2, L3 . . . Ln.

Each of transformers T1, T2, T3 . . . Tn includes its secondary winding which is equipped with multi-taps MT1, MT2, MT3 . . . MTn and a first adjustment member being provided with multi-tap switching circuits MTS1, MTS2, MTS3, . . . , MTSn which can switch-operate with the control of control unit 50. According to the control of control unit 50, multi-tap switching circuits MTS1, MTS2, MTS3, . . . , MTSn function to connect any one of the taps of multi-taps MT1, MT2, MT3, . . . , MTn to a ground. By making a voltage linkage with an induction to the respective secondary winding of transformers T1, T2, T3 . . . Tn, therefore, the induced voltages Vo_1, Vo_2, Vo_3 . . . Vo_n across the above respective secondary winding can be adjusted to the different level of from each other under the control of control unit 50. Then, the illumination intensity degrees of discharge lamps L1, L2, L3 . . . Ln are adjusted weakly or intensely with their whole combination or with their partial combination.

Figure 14:
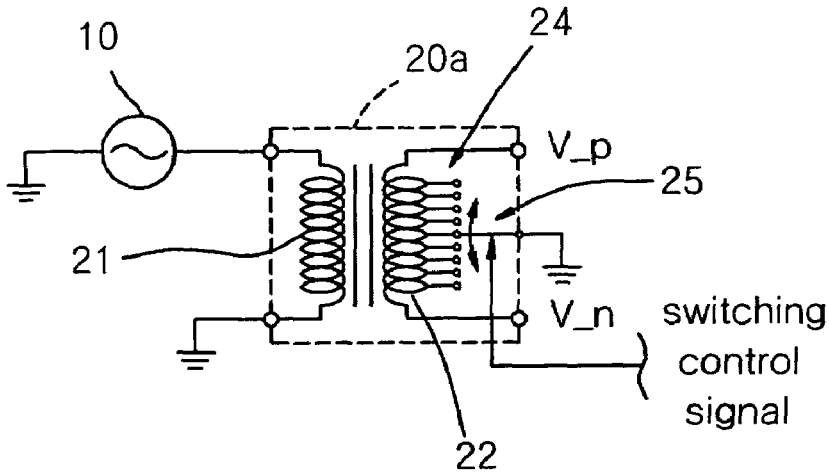
FIGS. 14 and 15 are detailed circuit diagrams showing various modifications of a power transformer according to second embodiment of the present invention.
Figure 15:
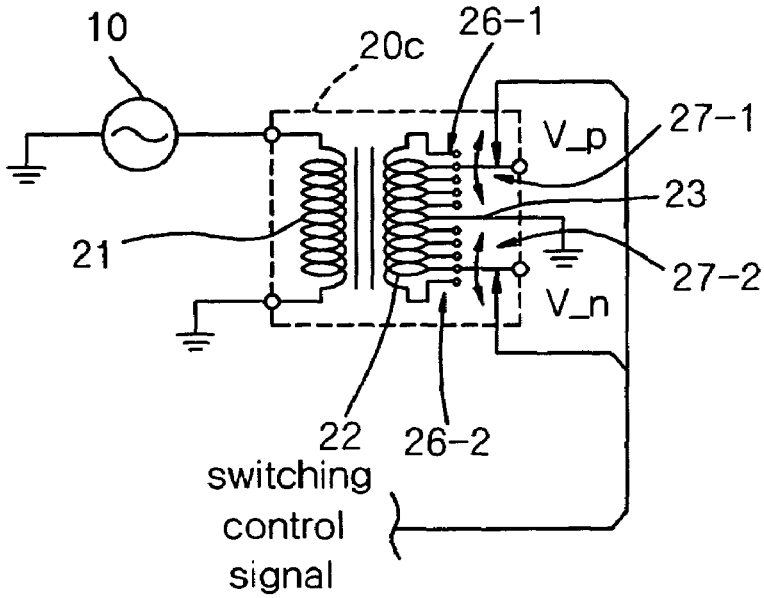

FIG. 14 and FIG. 15 show detailed circuit diagrams of various modification of power transformer 20 according to the second embodiment of this invention.

Referring to FIG. 14, a system for driving a multi-lamp includes power transformer 20*a* having a second adjustment member for variably adjusting the level of a positive voltage V_p or a negative voltage V_n of power transformer 20*a* under the control of control unit 50.

As shown in FIG. 14, power transformer 20*a* includes its secondary winding which is equipped with multi-tap 24 across its secondary winding and multi-tap switch circuit 25 as a second adjustment member capable of making the connection of any one of the taps to a ground under the control of control unit 50 so as to variably adjust the level of a positive voltage V_p or a negative voltage V_n of power transformer 20*a*.

The switch-operating of multi-tap switch circuit 25 under the control of control unit 50 is the variable adjustment about a ratio of a positive voltage V_p and a negative voltage V_n produced from power transformer 20*a*. Depending on the level change of a positive voltage V_p, the width of the level change of divided voltages Vo_1, Vo_2, Vo_3 . . . Vo_n produced from current balance distributor 60 can be adjusted narrowly or widely. For example, when a positive voltage V_p is made to be higher, the width of the level change of divided voltages Vo_1, Vo_2, Vo_3 . . . Vo_n is narrow. When a positive voltage V_p is made to be lower, the width of the level change of divided voltages Vo_1, Vo_2, Vo_3 . . . Vo_n is wide.

Referring to FIG. 15 which shows detailed circuit diagram of second modification of power transformer 20, power transformer 20*c* includes its secondary winding which is equipped with an intermediate tap 23 being electrically coupled to a ground, first multi-tap 26-1 being coupled between one end of its secondary winding and intermediate tap 23, second multi-tap 26-2 being coupled between the other end of its secondary winding and intermediate tap 23, first multi-tap switch circuit 27-1 for producing a positive voltage V_p with being coupled to any one tap of first multi-tap 26-1, and second multi-tap switch circuit 27-2 for producing a negative voltage V_n with being coupled to any one tap of second multi-tap 26-2.

Control unit 50 controls first and/or second multi-tap switch circuits 27-1 and 27-2 so as to variably adjust a ratio of a positive voltage V_p and a negative voltage V_n and the level of a positive voltage V_p and a negative voltage V_n. By controlling the level of a negative voltage V_n, for example, control unit 50 can weakly or intensely adjust the whole illumination intensity of discharge lamps L1, L2, L3 . . . Ln. Also, control unit 50 can adjust the level of a positive voltage V_p to carry out the adjustment function described in FIG. 12.

As a result, control unit 50 controls power transformer 20 and current balance distributor 60 so as to wholly or partially adjust an applied voltage across the corresponding one of discharge lamps L1, L2, L3 . . . Ln. Therefore, illumination intensities of discharge lamps L1, L2, L3 . . . Ln can be adjusted weakly or intensely with their whole combination or with their partial combination.

Figure 16:
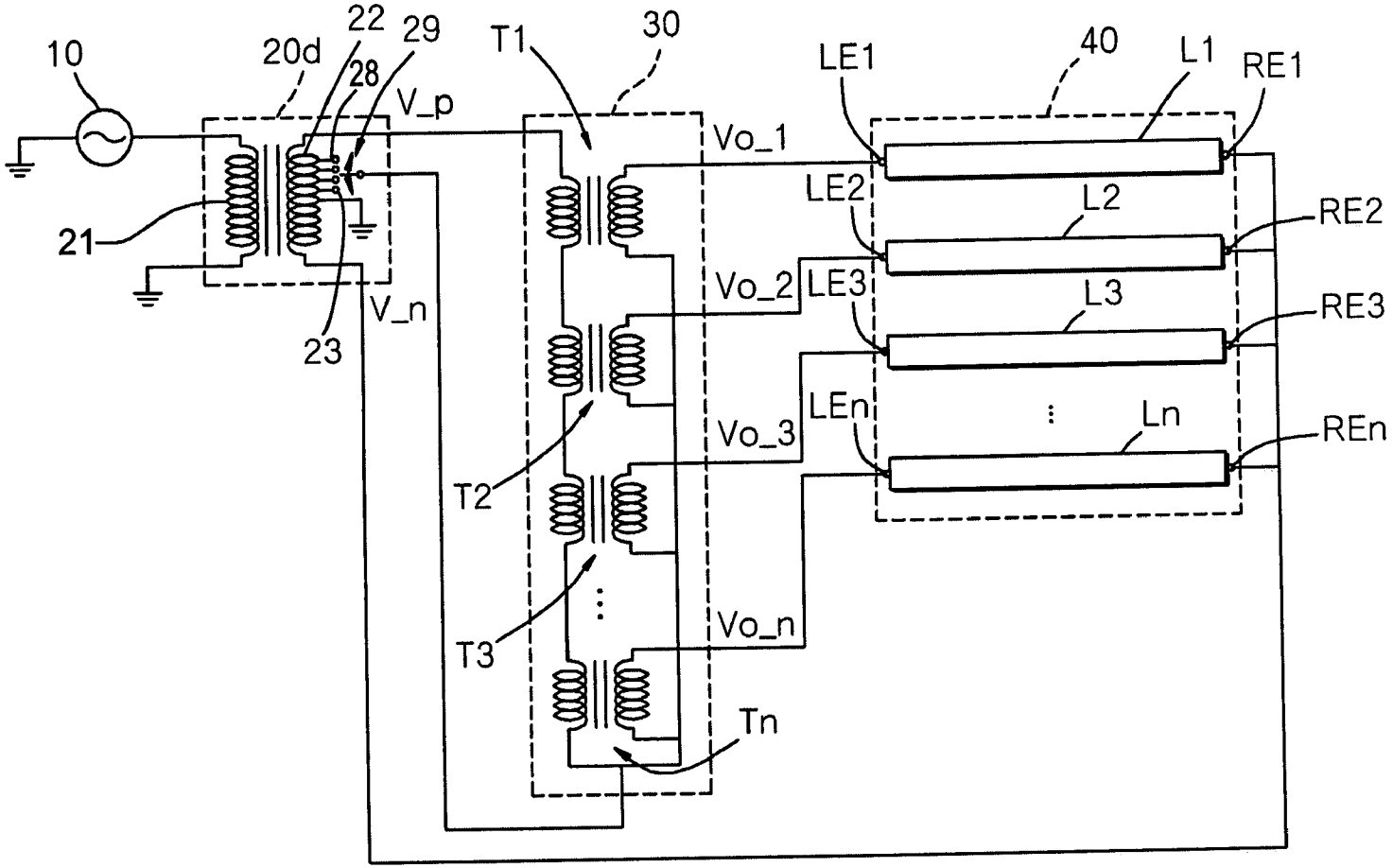
FIG. 16 is a block diagram showing a configuration of a system for driving multi-lamp according to third embodiment of this invention.

FIG. 16 shows a circuit diagram of a system for driving a multi-lamp according to a third embodiment of the invention.

In FIG. 16, configuration of multi-lamp driving system according to the third embodiment of the invention is almost the same as those of the systems for driving a multi-lamp according to the first and second embodiments of the invention. A system for a multi-lamp of FIG. 16 includes power transformer 20*d* which is another modification of transformer 20.

Power transformer 20*d* includes its primary winding 21 at which one end is coupled to an alternative power supply source 10 and other end is coupled to a ground. Further, power transformer 20*d* further includes its second winding 22 which is equipped with intermediate tap 23 being electrically connected to the ground. And, a positive voltage V_p is produced at a one end of secondary winding 22 of power transformer 20*d* and a negative voltage V_n is produced at the other end of secondary winding 22.

Power transformer 20*d* further includes its secondary winding which is also equipped with multi-tap 28 being coupled between intermediate tap 23 and a positive output terminal and multi-tap switch 29 being coupled to any one tap of multi-tap 28.

In a plurality of transformers T1, T2, T3 . . . Tn included in current balance distributor 30, each of their primary windings is in serial coupled between one end, that is, an output terminal of a positive voltage V_p at secondary winding 22 of power transformer 20*d* and multi-tap switch 29, and each of their secondary windings is coupled between multi-tap switch 29 and first electrodes LE1, LE2, L3 . . . LEn corresponding to discharge lamps L1, L2, L3 . . . Ln. The other ends of respective secondary winding in the plurality of transformers T1, T2, T3 . . . Tn are commonly coupled to multi-tap switch 29 of power transformer 20*d*.

Figure 17:
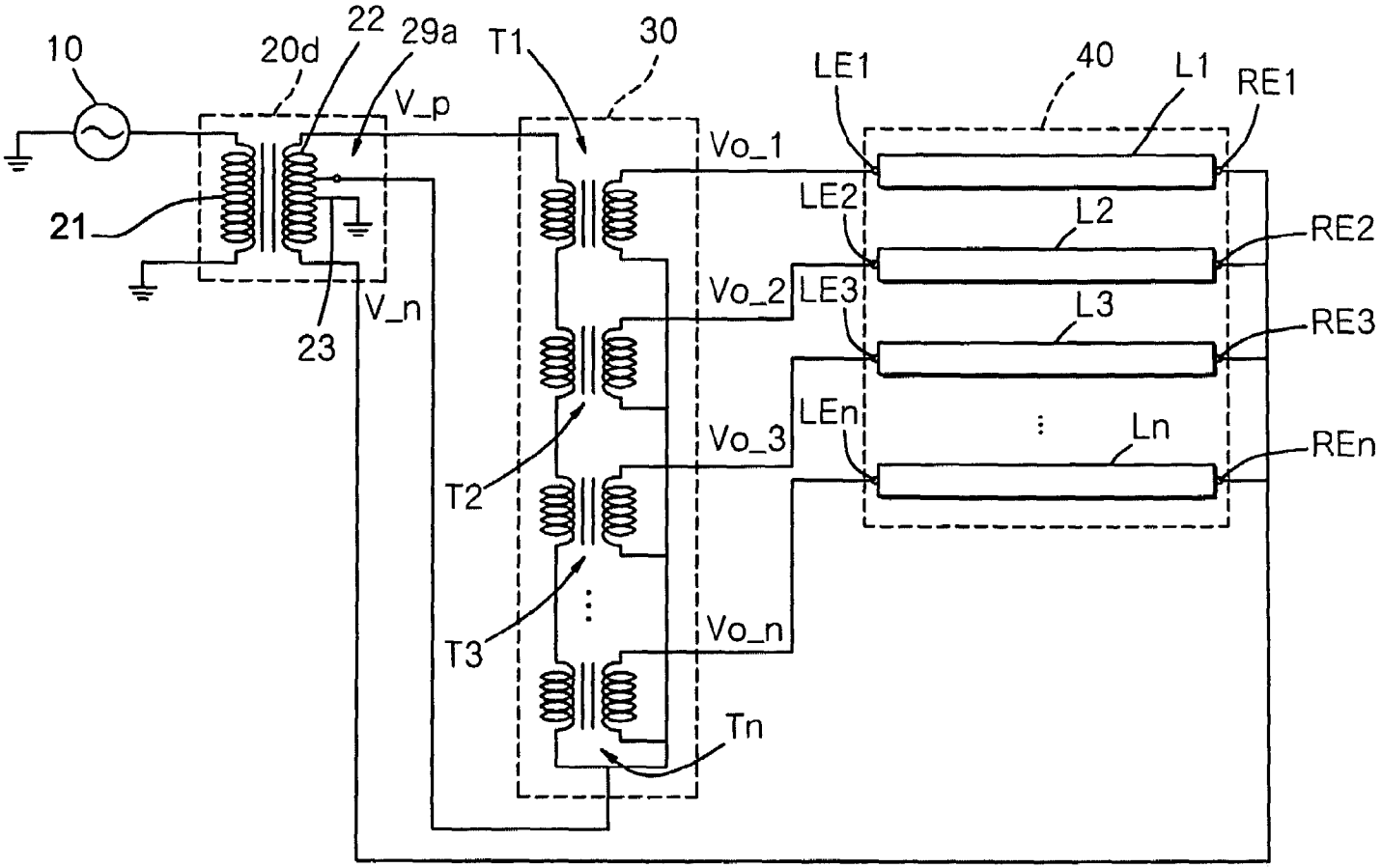
FIG. 17 is a detailed circuit diagram showing one exemplary of the construction of a multi-tap circuit of FIG. 16 according to third embodiment of the present invention.
Figure 18:
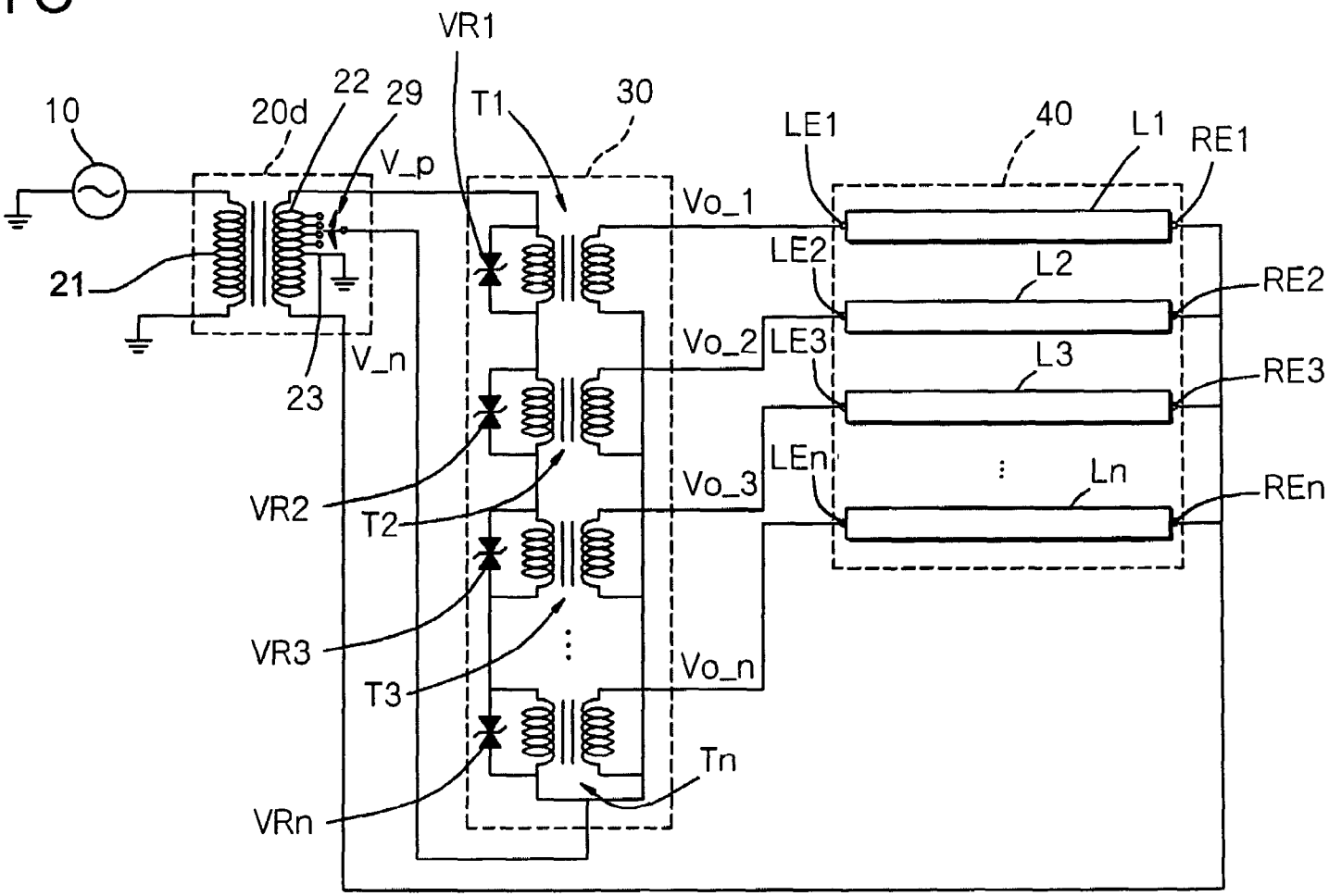
FIG. 18 is a detailed circuit diagram showing a configuration of the addition of a protection circuit to the structure of a current balance distributor.

In current balance distributor 30 having the above said configuration, plurality of transformers T1, T2, T3 . . . Tn can make an induction such that a level of an induced voltage by them should be higher than that of a ground depending on the switching position of multi-tap switch 29. The adjustment of current balance becomes carried out within a minimum range of electric power capable of covering a current unbalance existing in discharge lamps L1, L2, L3 . . . Ln. In the above construction, multi-tap switch 29 can be replaced with a fixed tap 29*a* as shown in FIG. 17. As shown in FIG. 18, protection circuits VR1 to VRn can be added to current balance distributor 30 as seen at the above described first embodiment.

As described above, the invention being thus described, it will be obvious that the same may be varied in many ways. For example, it may be possible to make the contrary replacement of positive and negative voltages in case of the application of a positive voltage to a current balance distributor. Such variations are not to be regarded as a departure from the spirit and scope of the invention, and all such modifications as would be obvious to one skilled in the art are intended to be included within the scope of the following claims.

According to a system and method for driving a multi-lamp of this invention as described above, it is possible to more efficiently drive a parallel arrangement of a plurality of discharge lamps and it is possible to enhance a equality of the illumination intensity of discharge lamps. Further, it is possible to have economic cost at the time of manufacturing by taking the adaptation of a simple construction compared with that of a conventional system for in parallel driving discharge lamps. Depending on characteristics of light intensity of an image to be displayed on a passive display apparatus and light intensity of an external circumstances, whole or partial illumination intensity of discharge lamps can be adjusted differently from each other, and therefore it is possible to realize a replay capacity of a high quality-scene having a high contrast in a passive display apparatus.

What is claimed is:

1. A system for driving a multi-lamp including:

a power transformer for producing a positive voltage and a negative voltage upon receipt of an alternative power source from an alternative power supply source; and, a current balance distributor for being supplied with the positive voltage produced from said power transformer to divide the supplied positive voltage into a plurality of predetermined voltages, and for respectively applying the divided predetermined voltages to the corresponding electrodes of a plurality of discharge lamps in a lamp array for the purpose of distributing an amount of a current flow so that the distributed current flow inputted into each of the discharge lamps may keep to make a mutual balance from each other, wherein the negative voltage is commonly applied to second electrodes of the discharge lamps.

2. The system for driving a multi-lamp according to claim 1, wherein said current balance distributor includes a plurality of transformers corresponding to discharge lamps, wherein while a respective primary winding of said transformers is in serial coupled between a ground and one end of their respective secondary winding, their respective secondary winding being coupled between a ground and the corresponding first electrodes of discharge lamps, and the divided predetermined voltages is applied to first electrodes of discharge lamps.

3. The system for driving a multi-lamp according to claim 1, wherein said power transformers each includes a primary winding of which one end is coupled to the alternative power supply source and other end is coupled to the ground; a secondary winding of which one end produces the positive voltage and other end produces the negative voltage; an intermediate tap of which one end is at the secondary winding coupled to the ground; a multi-tap being said intermediate tap and an output terminal at which the positive voltage is produced; and multi-tap switch being coupled to any one tap of said multi-tap, and said current balance distributor includes a plurality of transformers corresponding to discharge lamps; a respective primary winding of said transformers being in serial coupled between said multi-tap and a positive voltage outputting terminal of a secondary winding of said power transformer; and their respective secondary winding being coupled between said multi-tap switch and the corresponding first electrodes of discharge lamps.

4. The system for driving a multi-lamp according to claim 1, wherein said power transformers each is equipped with a primary winding of which one end is coupled to the alternative power supply source and other end is coupled to the ground; a secondary winding of which one end produces the positive voltage and other end produces the negative voltage; an intermediate tap of which one end is at the secondary winding coupled to the ground; and a fixed tap being coupling between said intermediate tap and an output terminal at which the positive voltage is produced, and said current balance distributor includes a plurality of transformers corresponding to discharge lamps; a respective primary winding of said transformers being in serial coupled between said fixed tap and a positive voltage outputting terminal of a respective secondary winding of said power transformer; and their respective secondary winding being coupled between said fixed tap and the corresponding first electrodes of the plurality of discharge lamps.

5. The system for driving a multi-lamp according to claim 2, wherein each of the plurality of transformers in said current balance distributor further includes a protection circuit for blocking the increasing of over-voltage from the corresponding transformer with being coupling across their respective primary winding.

6. The system for driving a multi-lamp according to claim 5, wherein said protection circuit is comprised of a varistor or a constant voltage diode.

7. The system for driving a multi-amp according to claim 1, wherein secondary winding of said power transformer is equipped with an intermediate tap being coupled to the ground.

8. The system for driving a multi-lamp according to claim 1, wherein said power transformer includes its secondary winding which is equipped with two divided windings wherein at one winding of two divided windings its one end produces a positive voltage and its other end is coupled to a ground and at other winding its one end is coupled to a ground and its other end produces a negative voltage.

9. The system for driving a multi-lamp according to claim 1, wherein said power transformer further includes its secondary winding which is equipped with a multi-tap being coupled across secondary winding and a multi-tap switch being coupled to any one tap of said multi-tap.

10. The system for driving a multi-lamp according to claim 1, wherein said power transformer includes its secondary winding which is equipped with:

an intermediate tap being electrically coupled to a ground;

first multi-tap being electrically coupled between said intermediate tap and one end of its secondary winding;

first multi-tap switch for producing a positive voltage with being coupled to any one tap of said first multi-tap;

second multi-tap being electrically coupled between said intermediate tap and other end of its secondary winding; and, second multi-tap switch for producing a negative voltage with being coupled to any one tap of said second multi-tap.

11. The system for driving a multi-lamp according to claim 1, wherein the lamp array including:

first and second magnetic cores for being respectively positioned at the peripheral of a pair of first and second electrodes of the corresponding discharge lamp in regard with the plurality of discharge lamps;

first winding for being winded around said first magnetic core, its one end being coupled to first electrode of the corresponding discharge lamp and other end being coupled to an divided voltage outputting terminal of said current balance distributor; and, second winding for being winded around said second magnetic core, its one end being coupled to second electrode of the corresponding discharge lamp and other end being commonly coupled to a negative voltage outputting terminal of said power transformer.

12. A driving method of a multi-lamp including steps of:

producing an alternative power source from an alternative power supply source;

dividing the produced alternative power source into a positive voltage and a negative voltage; and, applying a predetermined voltage to a respective first terminal of a plurality of discharge lamps after dividing the positive voltage into a plurality of the predetermined voltage and applying the negative voltage to a respective second terminal of the discharge lamps.

13. The driving method of a multi-lamp according to claim 12, wherein further includes step of distributing an amount of a current flow so that the distributed current flow inputted into each of the discharge lamps may keep to make a mutual balance from each other.

14. A system for of driving a multi-lamp including:

a power transformer for producing a positive voltage and a negative voltage upon receipt of an alternative power source from an alternative power supply source;

a current balance distributor for being supplied with the positive voltage produced from said power transformer to divide the supplied positive voltage into a plurality of predetermined voltages, and for applying the divided predetermined voltages to the corresponding first electrodes of a plurality of discharge lamps in a lamp array for the purpose of distributing an amount of a current flow so that the distributed current flow inputted into each of discharge lamps may keep to make a mutual balance from each other;

a first adjustment means for varied-adjusting the whole and/or partial level of the divided predetermined voltages applied to the corresponding first electrodes from said current balance distributor; and, a control unit for controlling said first adjustment means wherein the negative voltage of said power transformer is commonly applied to a second electrode of the discharge lamps and said first adjustment means under the control of said control unit can adjust the illumination intensity of the plurality of discharge lamps with a whole combination and/or a partial combination.

15. The system for driving a multi-lamp according to claim 14, wherein said current balance distributor includes a plurality of transformers corresponding to discharge lamps wherein a respective primary winding of transformers is coupled between a positive voltage outputting terminal of said power transformer and a ground, and a respective secondary winding of transformers applying the divided predetermined voltages to first electrode of the corresponding discharge lamp because of being coupling between a ground and first electrode of the corresponding discharge lamp in regard with the discharge lamps, and wherein the respective secondary winding of transformers is equipped with a multi-tap and first adjustment means includes a multi-tap switch circuit for making a connection of any one tap of said multi-tap to a ground under the control of said control unit.

16. The system for driving a multi-lamp according to claim 14, wherein further includes second adjustment means for varied-adjusting the level of the positive or negative voltage produced from secondary winding of said power transformer wherein said control unit can wholly and/or partially adjust the illumination intensity of the transformers through said first and/or second adjustment means.

17. The system for driving a multi-lamp according to claim 16, wherein said power transformer includes its secondary winding which is equipped with a multi-tap being coupled across its secondary winding, and second adjustment means includes a multi-tap switch circuit for making a connection of any one tap of said multi-tap to a ground under the control of said control unit.

18. The system for driving a multi-lamp according to claim 16, wherein said power transformer includes its secondary winding which is equipped with: an intermediate tap being electrically coupling to a ground; first multi-tap being coupled between said intermediate tap and other end of secondary winding of said power transformer; and second multi-tap for producing the negative voltage under the control of said control unit because of being coupled to any one tap of said second multi-tap, wherein second adjustment means includes first multi-tap switch circuit for producing the positive voltage under the control of said control unit because of being coupled to any one tap of said first multi-tap; and second multi-tap switch circuit for producing the negative voltage under the control of said control unit because of being coupled to any one tap of said second multi-tap.

19. The system for driving a multi-lamp according to one of claim 14, wherein the plurality of discharge lamps has a parallel arrangement for providing a light source of a passive display apparatus; and said control unit can variably control the illumination intensity of the discharge lamps on basis of a illumination information included in an image signal provided from an image signal source.

20. The system for driving a multi-lamp according to claim 19, wherein said control unit make a distinction about the corresponding respective scene displaying region of a passive display apparatus corresponding to a respective turned-on region and can separatively adjust the illumination intensity of the discharge lamps, base on a illumination information included in an image signal to be displayed on the respective turned-on region.

21. The system for driving a multi-lamp according to claim 19, wherein further includes a photo sensor for sensing the illumination intensity of an external circumstances; and said control unit can control the illumination intensity of the plurality of discharge lamps, based on the intensity level of external circumstances sensed from said photo sensor.

* * * * *